US010518991B2

(12) United States Patent
Harada

(10) Patent No.: US 10,518,991 B2
(45) Date of Patent: Dec. 31, 2019

(54) IMAGE FORMING APPARATUS AND FEEDING APPARATUS

(71) Applicant: CANON KABUSHIKI KAISHA, Tokyo (JP)

(72) Inventor: Shingo Harada, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 219 days.

(21) Appl. No.: 15/823,342

(22) Filed: Nov. 27, 2017

(65) Prior Publication Data

US 2018/0147865 A1 May 31, 2018

(30) Foreign Application Priority Data

Nov. 30, 2016 (JP) ..... 2016-233346

(51) Int. Cl.

| | |
|---|---|
| ***B65H 1/14*** | (2006.01) |
| ***B41J 13/10*** | (2006.01) |
| ***G03G 15/00*** | (2006.01) |
| ***B41J 13/00*** | (2006.01) |
| ***B65H 1/18*** | (2006.01) |

(Continued)

(52) U.S. Cl.

CPC ..... *B65H 1/14* (2013.01); *B41J 13/0018* (2013.01); *B41J 13/103* (2013.01); *B65H 1/18* (2013.01); *B65H 7/04* (2013.01); *B65H 7/20* (2013.01); *G03G 15/6511* (2013.01); *G03G 15/6564* (2013.01); *B65H 2511/152* (2013.01);

(Continued)

(58) Field of Classification Search

CPC ... B65H 1/14; B65H 1/18; B65H 7/00; B65H 7/02; B65H 7/04; B65H 7/14; B65H 7/20; B65H 2511/15; B65H 2511/152; G03G 15/6511; G03G 15/6564

See application file for complete search history.

(56) References Cited

U.S. PATENT DOCUMENTS

2010/0123280 A1* 5/2010 Miyazawa ..... B65H 1/14 271/3.09
2010/0133745 A1* 6/2010 Ikeuchi ..... B65H 1/14 271/265.04

(Continued)

FOREIGN PATENT DOCUMENTS

JP H0977304 A 3/1997
JP 2007210763 A 8/2007

(Continued)

*Primary Examiner* — Prasad V Gokhale

(74) *Attorney, Agent, or Firm* — Canon USA, Inc., IP Division

(57) ABSTRACT

An image forming apparatus includes a housing unit that includes an intermediate plate, a lift-up unit, a first detection unit, a second detection unit, a feeding unit, a control unit, a first acquisition unit that acquires a first driving amount, a storage unit that stores a threshold, a determination unit that determines that a recording material is overloaded on the intermediate plate when the first driving amount is smaller than the threshold, a second acquisition unit that acquires a second driving amount, a correction unit that obtains a differential amount by subtracting a predetermined driving amount from the second driving amount acquired by the second acquisition unit, and corrects, on a basis of the differential amount, the threshold stored in the storage unit or the first driving amount acquired by the first acquisition unit.

21 Claims, 12 Drawing Sheets

(51) Int. Cl.
*B65H 7/04* (2006.01)
*B65H 7/20* (2006.01)

(52) U.S. Cl.
CPC ..... *B65H 2801/06* (2013.01); *G03G 15/5008* (2013.01); *G03G 15/758* (2013.01)

(56) References Cited

U.S. PATENT DOCUMENTS

| | | | | |
|---|---|---|---|---|
| 2014/0203496 | A1* | 7/2014 | Hamasaki | B65H 1/266 271/18 |
| 2017/0160688 | A1* | 6/2017 | Kurohata | B65H 1/04 |
| 2017/0345244 | A1* | 11/2017 | Wada | G07D 9/00 |

FOREIGN PATENT DOCUMENTS

| | | | |
|---|---|---|---|
| JP | 2013035689 | A | 2/2013 |
| JP | 2015229590 | A | 12/2015 |

* cited by examiner

IMAGE FORMING APPARATUS AND FEEDING APPARATUS

BACKGROUND

Field

The present disclosure generally relates to an image forming apparatus and a feeding apparatus that determine whether or not a recording material is overloaded on an intermediate plate of a cassette.

Description of the Related Art

Conventionally, some image forming apparatuses such as copiers or printers determine whether or not a recording material is overloaded on an intermediate plate of a cassette. When the recording material is overloaded, a great pressure more than necessary is applied from a feeding roller to the recording material, so that it is difficult for the recording material to be normally fed from the cassette, thus causing sheet jamming. Therefore, an image forming apparatus that determines whether or not a recording material is overloaded before feeding the recording material from a cassette, and when determining that the recording material is overloaded, notifies a user of the overloading, and thereby prevents occurrence of sheet jamming is proposed.

Japanese Patent Laid-Open No. 2013-35689 describes an image forming apparatus that has a first sensor detecting that a lift-up operation of an intermediate plate of a cassette starts and a second sensor detecting that a recording material has reached a feeding position by the lift-up operation. The image forming apparatus described in Japanese Patent Laid-Open No. 2013-35689 measures a time from when the first sensor detects the start of the lift-up operation to when the second sensor detects the recording material, and compares the lift-up time that is measured to a threshold time that is set in advance. When the lift-up time that is measured is shorter than the threshold time, the image forming apparatus determines that the recording material is overloaded.

In Japanese Patent Laid-Open No. 2013-35689, the threshold time to determine overloading is set to a fixed value on the basis of a lift-up time when the recording material with a maximum loading amount is loaded on the intermediate plate. However, even in image forming apparatuses having the same configuration, the lift-up time may vary between the apparatuses. This is because a degree of deformation of an elastic member, such as wire, that constitutes a lift-up mechanism varies between the apparatuses or a position at which a sensor for detecting that a recording material has reached a feeding position is installed varies between the apparatuses.

Thus, in the determination of overloading by Japanese Patent Laid-Open No. 2013-35689, although the recording material is actually overloaded, it may be erroneously determined that the recording material is not overloaded because of influence of the variation as described above. As a result, there is a case where it is difficult to prevent occurrence of sheet jamming. Control described in Japanese Patent Laid-Open No. 2013-35689 sufficiently satisfies accuracy for determination of overloading, which is desired at the time, but is required to achieve more enhancement of the accuracy.

SUMMARY

According to aspects of the invention, whether or not a recording material is overloaded is accurately determined without influence of a variation factor between apparatuses.

An image forming apparatus according to aspects of the invention is an image forming apparatus that forms an image on a recording material, and includes: a housing unit that includes an intermediate plate on which a recording material is loaded and is attachable to or detachable from the image forming apparatus; a lift-up unit that lifts up the intermediate plate along a vertical direction with driving force supplied from a driving source; a first detection unit that detects that the recording material loaded on the intermediate plate which is lifted up by the lift-up unit has reached a feeding position; a second detection unit that detects presence of the recording material on the intermediate plate; a feeding unit that feeds the recording material which has reached the feeding position; a control unit that, when the housing unit is attached to the image forming apparatus, executes first lift-up control through which the intermediate plate is lifted up by the lift-up unit until the first detection unit detects that the recording material has reached the feeding position, and after the first lift-up control, executes second lift-up control through which when the first detection unit does not detect the recording material because the recording material has been fed by the feeding unit, the intermediate plate is lifted up by the lift-up unit until the first detection unit detects again that the recording material has reached the feeding position; a first acquisition unit that acquires a first driving amount serving as a driving amount of the driving source when the first lift-up control is executed until the first detection unit detects that the recording material has reached the feeding position; a storage unit that stores a threshold for determining overloading of the recording material on the intermediate plate; a determination unit that determines that the recording material is overloaded on the intermediate plate when the first driving amount acquired by the first acquisition unit is smaller than the threshold; a second acquisition unit that acquires a second driving amount obtained by adding the first driving amount to a cumulative driving amount of the driving source when the second lift-up control is executed until the second detection unit detects that there is no recording material on the intermediate plate; and a correction unit that obtains a differential amount by subtracting a predetermined driving amount from the second driving amount acquired by the second acquisition unit, and corrects, on a basis of the differential amount, the threshold stored in the storage unit or the first driving amount acquired by the first acquisition unit.

A feeding apparatus according to aspects of the invention is a feeding apparatus that feeds a recording material, and includes: a housing unit that includes an intermediate plate on which a recording material is loaded and is attachable to or detachable from the feeding apparatus; a lift-up unit that lifts up the intermediate plate along a vertical direction with driving force supplied from a driving source; a first detection unit that detects that the recording material loaded on the intermediate plate which is lifted up by the lift-up unit has reached a feeding position; a second detection unit that detects presence of the recording material on the intermediate plate; a feeding unit that feeds the recording material which has reached the feeding position; a control unit that, when the housing unit is attached to the feeding apparatus, executes first lift-up control through which the intermediate plate is lifted up by the lift-up unit until the first detection unit detects that the recording material has reached the feeding position, and after the first lift-up control, executes second lift-up control through which when the first detection unit does not detect the recording material because the recording material has been fed by the feeding unit, the intermediate plate is lifted up by the lift-up unit until the first detection unit detects again that the recording material has reached the feeding position; a first acquisition unit that acquires a first driving amount serving as a driving amount of the driving source when the first lift-up control is executed until the first detection unit detects that the recording material has reached the feeding position; a storage unit that stores a threshold for determining overloading of the recording material on the intermediate plate; a determination unit that determines that the recording material is overloaded on the intermediate plate when the first driving amount acquired by the first acquisition unit is smaller than the threshold; a second acquisition unit that acquires a second driving amount obtained by adding the first driving amount to a cumulative driving amount of the driving source when the second lift-up control is executed until the second detection unit detects that there is no recording material on the intermediate plate; and a correction unit that obtains a differential amount by subtracting a predetermined driving amount from the second driving amount acquired by the second acquisition unit, and corrects, on a basis of the differential amount, the threshold stored in the storage unit or the first driving amount acquired by the first acquisition unit.

Further features of aspects of the present invention will become apparent from the following description of exemplary embodiments with reference to the attached drawings.

DESCRIPTION OF THE EMBODIMENTS

Embodiment 1

Figure 1:
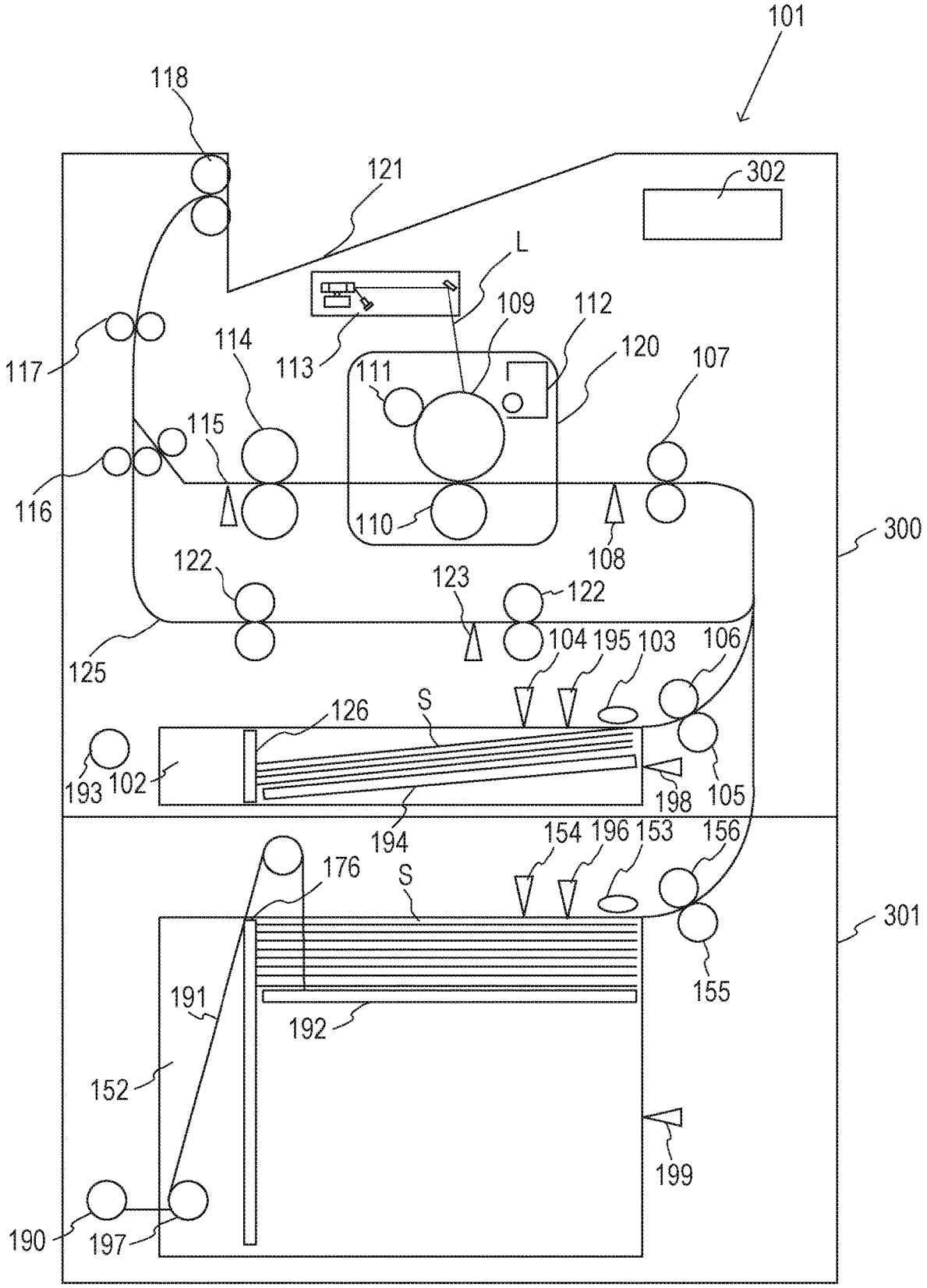
FIG. 1 is a schematic structural view of an image forming apparatus.

FIG. 1 is a schematic structural view of an image forming apparatus in the present embodiment. In the present embodiment, a laser beam printer 101 (hereinafter, represented as a printer 101) is indicated as an example of the image forming apparatus. The printer 101 has a printer main body 300 and a feeding option device 301. The feeding option device 301 is configured to be attachable to or detachable from the printer main body 300 and feeds a sheet S (recording material) to the printer main body 300 in a state of being attached to the printer main body 300. Note that, it may be configured so that the printer main body 300 and the feeding option device 301 are integrated and the feeding option device 301 is not able to be detached. The printer 101 is provided with an operation panel 302 on which various information is able to be displayed.

Figure 2:
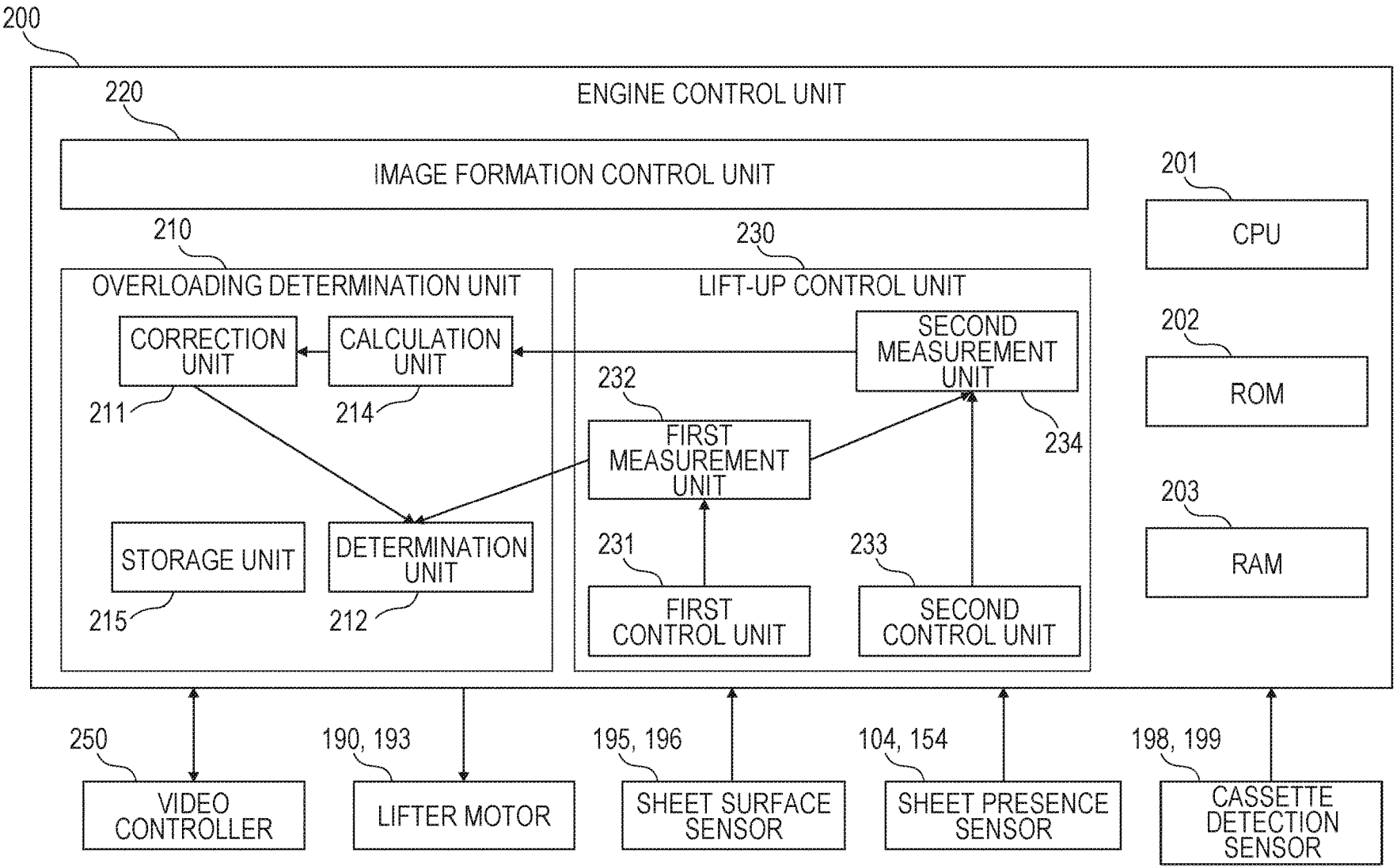
FIG. 2 is a control block diagram of the image forming apparatus.

When receiving a printing request from a video controller 250 illustrated in FIG. 2, the printer 101 starts preliminary preparation for printing. The preliminary preparation for printing is starting each actuator, a laser scanner 113 serving as an exposure device, an image forming unit 120, and a fixing device 114. When the preliminary preparation is completed, the sheet S (recording material) is fed from a feeding cassette 102 or an option feeding cassette 152 (housing unit).

In the feeding cassette 102 and the option feeding cassette 152, sheets S are loaded on intermediate plates 194 and 192 and housed with trailing end positions in conveyance directions regulated by trailing end regulators 126 and 176. When a sheet S is fed from the feeding cassette 102 or the option feeding cassette 152, a pickup roller 103 or 153 rotates. The sheet S fed by the pickup roller 103 or 153 is conveyed by a feeding roller 106 or 156 and conveyed to a top sensor 108 via a registration roller 107. A separation roller 105 or 155 forms a separation nip with the feeding roller 106 or 156 and separates a plurality of sheets S, which are fed in an overlapping manner by the pickup roller 103 or 153, into one sheet. Thereby, only the uppermost sheet S is conveyed to the registration roller 107. After a leading end of the sheet S is detected by the top sensor 108, the sheet S is conveyed to the image forming unit 120. Note that, which of the feeding cassette 102 and the option feeding cassette 152 is to feed the sheet S is decided on the basis of the printing request from the video controller 250.

The image forming unit 120 includes a photosensitive drum 109, a transfer roller 110, a charging roller 111, and a developing device 112. The photosensitive drum 109 is uniformly charged by the charging roller 111, and then is irradiated with laser light L output from the laser scanner 113, and has an electrostatic latent image formed on a surface thereof. When toner is supplied from the developing device 112, the electrostatic latent image formed in this manner is visualized as a toner image. With rotation of the photosensitive drum 109, the toner image formed on the photosensitive drum 109 is moved to a transfer nip, and the sheet S is also conveyed to the transfer nip in synchronization with the rotation of the photosensitive drum 109. At the transfer nip, a voltage of an opposite polarity to that of the toner image is applied to the transfer roller 110 and the toner image on the photosensitive drum 109 is transferred onto the sheet S. The sheet S onto which the toner image is transferred is conveyed to the fixing device 114 to be subjected to heat and pressure, and the toner image is fixed to the sheet S. The sheet to which the toner image is fixed is conveyed by triple rollers 116, an intermediate discharge roller 117, and a discharge roller 118, and discharged to a discharge tray 121. Thus, a sequence of print operations is finished.

Note that, when an image is formed on a back surface of the sheet S, after a trailing end of the sheet S passes through the triple rollers 116, the triple rollers 116, the intermediate discharge roller 117, and the discharge roller 118 rotate in a reverse direction and the sheet S is conveyed to a double-side conveyance path 125. Further, the sheet S is conveyed by a double-side conveyance roller 122 and conveyed again to the registration roller 107. A fixing discharge sensor 115 and a double-side conveyance sensor 123 are provided to detect whether the sheet S is normally conveyed. Note that, such a sequence of processing is controlled by an engine control unit 200 (illustrated in FIG. 2) described below.

The printer 101 is provided with a lifter motor 193 serving as a driving source for lifting up the intermediate plate 194 of the feeding cassette 102 and a lifter motor 190 serving as a driving source for lifting up the intermediate plate 192 of the option feeding cassette 152.

The printer 101 is provided with a sheet surface sensor 195 that detects a sheet surface of the sheet S loaded on the intermediate plate 194 of the feeding cassette 102 and a sheet presence sensor 104 that detects presence of the sheet S on the intermediate plate 194. The feeding cassette 102 is configured to be attachable to or detachable from the printer 101 to supply the sheet S, and the printer 101 is provided with a cassette detection sensor 198 that detects whether the feeding cassette 102 is attached to or detached from the printer 101.

The printer 101 is provided with a sheet surface sensor 196 that detects a sheet surface of the sheet S loaded on the intermediate plate 192 of the option feeding cassette 152 and a sheet presence sensor 154 that detects presence of the sheet S on the intermediate plate 192. The option feeding cassette 152 is configured to be attachable to or detachable from the printer 101 to supply the sheet S. The printer 101 is provided with a cassette detection sensor 199 that detects whether the option feeding cassette 152 is attached to or detached from the printer 101. Further, a wire 191 is provided between the intermediate plate 192 of the option feeding cassette 152 and the lifter motor 190, and it is configured so that the intermediate plate 192 is lifted up along a vertical direction when the wire 191 is wound around a wire reel 197. The wire reel 197 is detachably connected to the lifter motor 190 provided in the printer 101 by a coupling mechanism (not illustrated). When the option feeding cassette 152 is attached to the printer 101, the wire reel 197 is connected to the lifter motor 190 and rotates upon reception of driving force from the lifter motor 190.

Next, a control block diagram of the image forming apparatus in the present embodiment is illustrated in FIG. 2. The engine control unit 200 has a CPU 201, a ROM 202, and a RAM 203. The engine control unit 200 also has an image formation control unit 220, a lift-up control unit 230, and an overloading determination unit 210, and such control units are integrally controlled by the CPU 201.

The lift-up control unit 230 has a first control unit 231, a first measurement unit 232, a second control unit 233, and a second measurement unit 234. The overloading determination unit 210 has a determination unit 212, a correction unit 211, a calculation unit 214, and a storage unit 215. The engine control unit 200 is connected to each of the video controller 250, the lifter motors 190 and 193, the sheet surface sensors 195 and 196, the sheet presence sensors 104 and 154, and the cassette detection sensors 198 and 199.

The image formation control unit 220 controls the image forming unit 120 and the fixing device 114 while conveying the sheet S by driving a motor rotating a roller pair on a conveyance path, thereby forming the toner image on the sheet S.

Next, a function of the lift-up control unit 230 will be described. Though description will be given below for control of the option feeding cassette 152, it is also applicable to determination of overloading related to the feeding cassette 102 as described below.

The lift-up control unit 230 performs lift-up control related to the intermediate plate 192. The lift-up control is control for driving the lifter motor 190 and lifting up the intermediate plate 192 until the sheet surface of the sheet S is detected by the sheet surface sensor 196. When the sheet surface of the sheet S is detected by the sheet surface sensor 196, the uppermost sheet S among sheets S loaded on the intermediate plate 192 is lifted up to a feeding position. The sheet S lifted up to the feeding position is subjected to appropriate feeding pressure from the pickup roller 153 and is thus normally fed.

The option feeding cassette 152 is configured to be attachable to or detachable from the printer 101. When the option feeding cassette 152 is detached from the printer 101, the intermediate plate 192 is lowered. This is because when the option feeding cassette 152 is detached from the printer 101, connection between the lifter motor 190 provided in a main body and the wire reel 197 provided in the cassette is disconnected.

On the other hand, when the cassette detection sensor 199 detects that the option feeding cassette 152 is attached to the printer 101, the engine control unit 200 requests the first control unit 231 to start initial lift-up control (first lift-up control). In response to the request of the engine control unit 200, the first control unit 231 drives the lifter motor 190 and lifts up the intermediate plate 192. The driving of the lifter motor 190 by the first control unit 231 is continuously performed until the sheet surface sensor 196 detects the sheet surface of the uppermost sheet S or the intermediate plate 192. The case where the sheet surface sensor 196 detects the intermediate plate 192 refers to a case where no sheet S is loaded on the intermediate plate 192. After that, when the sheet surface sensor 196 detects the sheet surface of the sheet S, the first control unit 231 stops the lifter motor 190. In this manner, the first control unit 231 lifts up sheets S of the option feeding cassette 152 to the feeding position.

After the initial lift-up control, an image forming operation is executed and the sheets S are fed one by one from the option feeding cassette 152, and then, a level of the sheet surface is gradually reduced. As a result, the sheet surface sensor 196 is not able to detect the sheet surface of the sheet S. When the sheet surface sensor 196 is not able to detect the sheet surface of the sheet S, the engine control unit 200 requests the second control unit 233 to start additional lift-up control (second lift-up control). In response to the request of the engine control unit 200, the second control unit 233 drives the lifter motor 190 and lifts up the intermediate plate 192. Similarly to the case of the initial lift-up control, the driving of the lifter motor 190 by the second control unit 233 is continuously performed until the sheet surface sensor 196 detects the sheet surface. In this manner, the second control unit 233 lifts up sheets S of the option feeding cassette 152 to the feeding position again. Functions of the first measurement unit 232 and the second measurement unit 234 will be described later.

Next, a function of the overloading determination unit 210 will be described. A state where sheets S are overloaded on the intermediate plate 192 of the option feeding cassette 152 refers to a state where sheets S beyond a prescribed amount of the option feeding cassette 152 are loaded. When sheets S are overloaded, great feeding pressure more than necessary is applied to the sheets S from the pickup roller 153 and the sheets S are not able to be normally fed, so that sheet jamming may occur. Thus, the printer 101 of the present embodiment determines whether or not sheets S are overloaded before the sheets S are fed from the option feeding cassette 152, thus making it possible to prevent the occurrence of the sheet jamming.

First, a method for determining overloading in a related art will be described as a comparative example to the present embodiment. The first measurement unit 232 of the lift-up control unit 230 measures (acquires) a driving amount (first driving amount) of the lifter motor 190 in the initial lift-up control executed when the option feeding cassette 152 is attached to the printer 101. In this case, when a stepping motor is used as the lifter motor 190, a driving step number of the stepping motor is able to be obtained as the driving amount of the lifter motor 190. When the driving amount of the lifter motor 190 measured by the fist measurement unit 232 is smaller than a threshold that is stored in advance in the storage unit 215, the determination unit 212 of the overloading determination unit 210 determines that sheets S are overloaded. In the determination method as the comparative example, the threshold for determining overloading is set to a fixed value on the basis of a driving amount when sheets S with a maximum loading amount are loaded on the intermediate plate 192.

Here, the driving amount of the lifter motor 190 in the initial lift-up control varies between apparatuses due to influence of a variation factor between the apparatuses. Thus, when the threshold is uniformly set to the fixed value as in the comparative example, overloading is not able to be accurately determined in some cases. The variation factor between the apparatuses will be described in detail with reference to FIG. 3.

Figure 3:
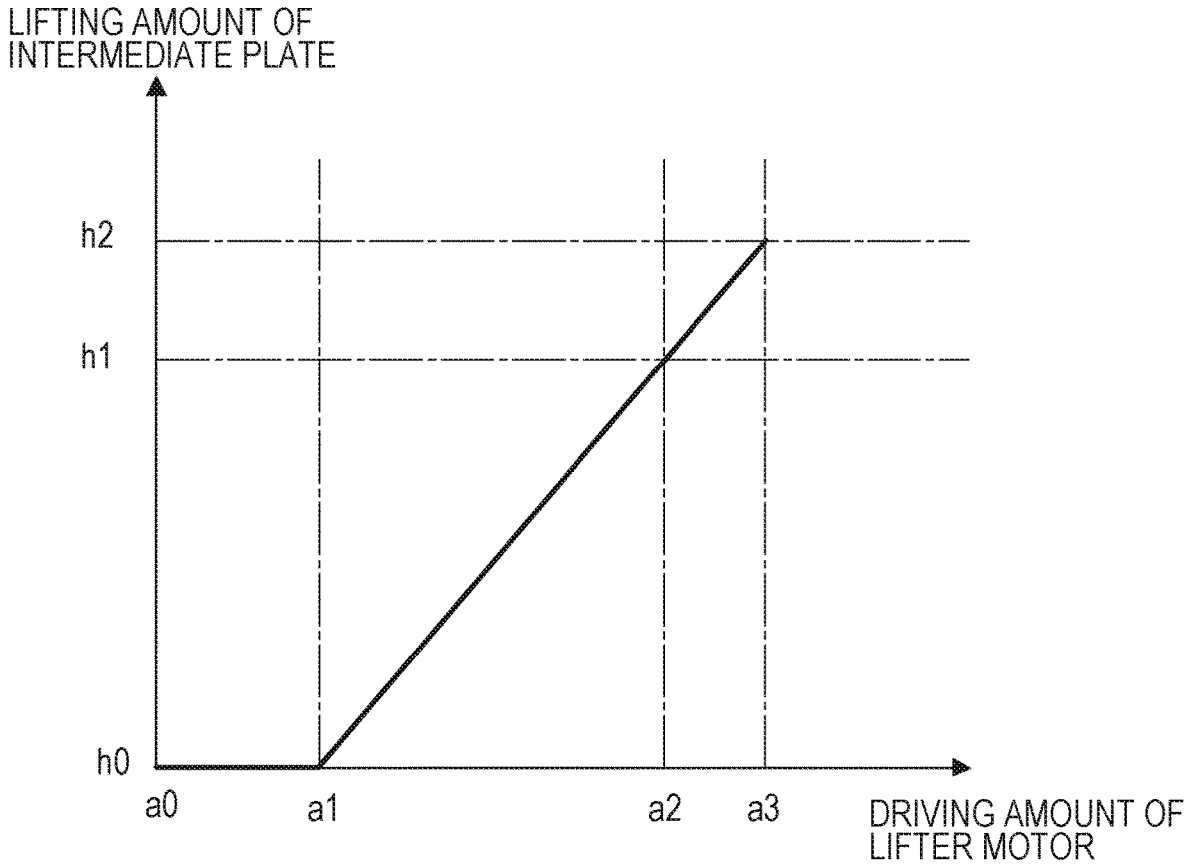
FIG. 3 is a view for explaining a relation between a driving amount of a lifter motor and a lifting amount of an intermediate plate.

FIG. 3 is a graph illustrating a relation between a driving amount of the lifter motor 190 and a lifting amount of the intermediate plate 192, in which a horizontal axis indicates the driving amount of the lifter motor 190 and a vertical axis indicates the lifting amount of the intermediate plate 192. According to FIG. 3, it is found that the intermediate plate 192 is not lifted up until the lifter motor 190 is driven by a1 immediately after driving of the lifter motor 190 starts. This is because, for example, a slack of the wire 191 suspending the intermediate plate 192 is eliminated, and elongation of the wire 191 due to elasticity or backlash of the wire reel 197 is eliminated. When they are eliminated, the intermediate plate 192 starts to be lifted up. Here, characteristics of the wire 191 vary between apparatuses, and there is also a case where, in another apparatus, the intermediate plate 192 does not start to be lifted up unless the lifter motor 190 is driven by a driving amount greater than a1.

Moreover, the lifting amount of the intermediate plate 192 until reaching the sheet surface sensor 196 that is installed at an ideal position obtained from a design drawing is denoted by h1 in FIG. 3. The lifting amount of the intermediate plate 192 until reaching the sheet surface sensor 196 that is installed at a position higher than the ideal position is denoted by h2 in FIG. 3. When the actual installation position of the sheet surface sensor 196 is the same as the ideal position, the lifter motor 190 is driven by a2 to lift up the intermediate plate 192 by h1. On the other hand, when the actual installation position of the sheet surface sensor 196 is higher than the ideal position as illustrated in FIG. 3, the lifter motor 190 is driven by a3 to lift up the intermediate plate 192 by h2. Here, the actual installation position of the sheet surface sensor 196 varies between apparatuses, and there is also a case where, in another apparatus, the intermediate plate 192 does not reach the position of the sheet surface sensor 196 and the lift-up control is not finished unless the lifter motor 190 is driven by a driving amount greater than a3.

As described above, the driving amount of the lifter motor 190 until the uppermost sheet S reaches the position of the sheet surface sensor 196 after the intermediate plate 192 is lifted up varies between apparatuses. Thus, the overloading determination unit 210 of the present embodiment calculates a differential value between an actual measurement value and a reference value of the driving amount of the lifter motor 190 and corrects a threshold on the basis of a result of the calculation, thereby improving accuracy for determination of overloading.

A method for determining overloading according to the present embodiment will be described below. The determination method of the present embodiment is obtained by adding a step of correcting a threshold to the determination method of the comparative example.

In FIG. 2, the second measurement unit 234 of the lift-up control unit 230 obtains a cumulative driving amount of the lifter motor 190 when the additional lift-up control is executed until the sheet S of the option feeding cassette 152 is out. Then, the driving amount of the lifter motor 190 obtained through the initial lift-up control by the first measurement unit 232 is added to the cumulative driving amount. Thereby, the second measurement unit 234 acquires a driving amount (second driving amount) of the lifter motor 190 until the intermediate plate 192 reaches the sheet surface sensor 196 after the option feeding cassette 152 is attached to the printer 101. Note that, the state where the sheet S of the option feeding cassette 152 is out is able to be detected by the sheet presence sensor 154.

The calculation unit 214 calculates a differential amount by subtracting a reference value from the driving amount (actual measurement value) of the lifter motor 190 measured by the second measurement unit 234. Here, the reference value is a driving amount of the lifter motor 190 until the intermediate plate 192 is detected by the sheet surface sensor 196 at the ideal position after the intermediate plate 192 positioned at the lowest position starts to be lifted up, corresponds to (a2−a1) in FIG. 3, and is stored in advance in the storage unit 215. The reference value is able to be obtained in advance from the design drawing. For example, the reference value is able to be obtained in accordance with a difference of designed heights of the sheet surface sensor 196 installed at the ideal position and the intermediate plate 192 at the position before the lift-up, and a driving amount of the lifter motor 190 per unit designed height. Here, the position before the lift-up is a position at which the intermediate plate 192 is lowered most in a vertical direction.

The driving amount of the lifter motor 190 measured by the second measurement unit 234 corresponds to (a3−a0) in FIG. 3. Thus, this driving amount includes a driving amount (a1−a0) until the intermediate plate 192 starts to be lifted up after driving of the lifter motor 190 starts and a driving amount (a3−a2) caused by an error of the installation position of the sheet surface sensor 196. By subtracting the reference value from the actual measurement value, the calculation unit 214 calculates (a1−a0)+(a3−a2) in FIG. 3 as the differential amount.

The correction unit 211 corrects a threshold for determining overloading, which is stored in the storage unit 215, on the basis of the differential amount calculated by the calculation unit 214. In the present embodiment, a method for correcting the threshold by adding the differential amount to the threshold which has been already stored is used. After the threshold is corrected, the determination unit 212 performs the determination of overloading by the method described in the comparative example, that is, by comparing the driving amount of the lifter motor 190 measured by the first measurement unit 232 to the corrected threshold.

Figure 4A:
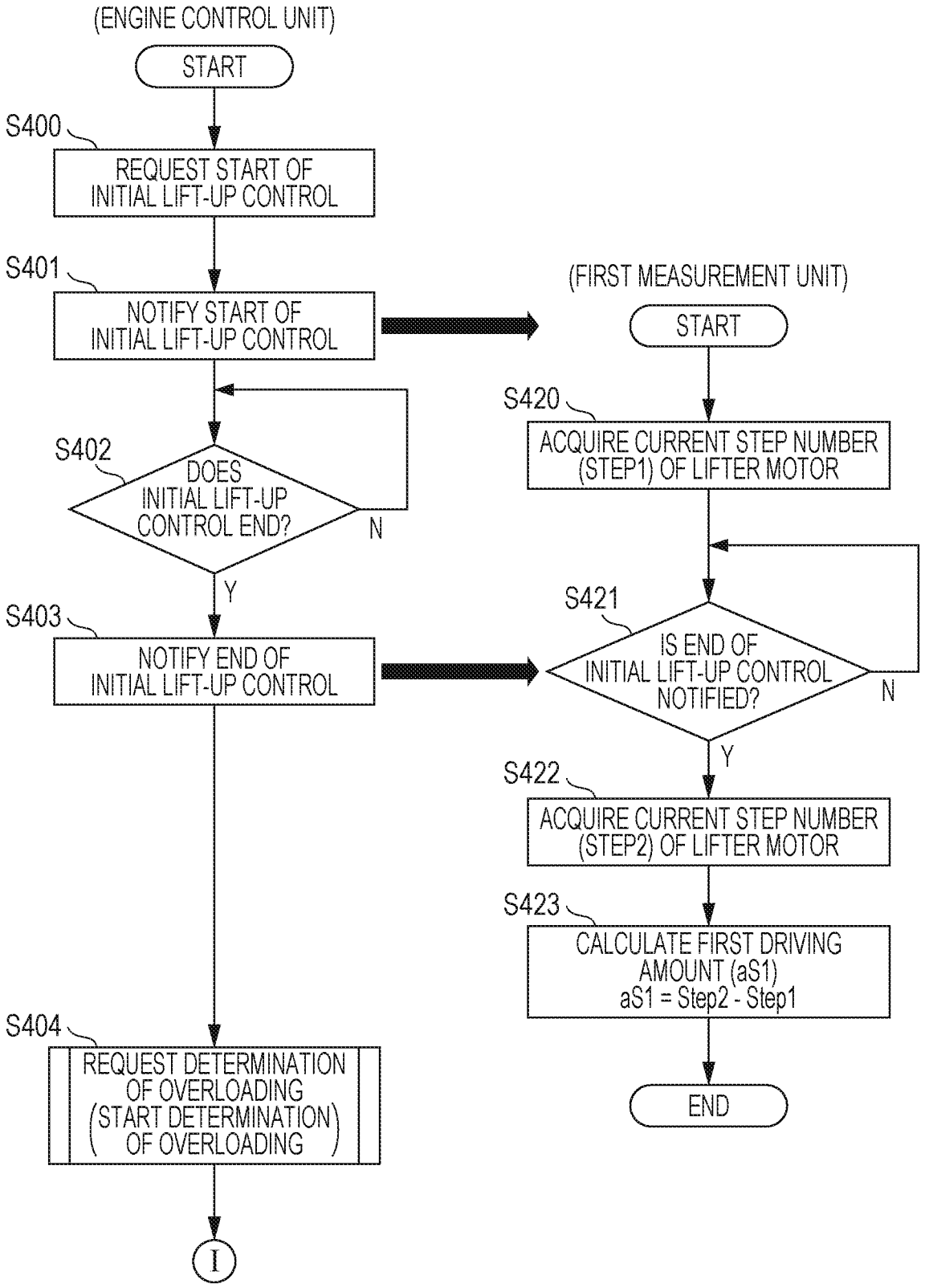
FIGS. 4A and 4B are operation flowcharts of an engine control unit, a first measurement unit, and a second measurement unit.
Figure 4B:
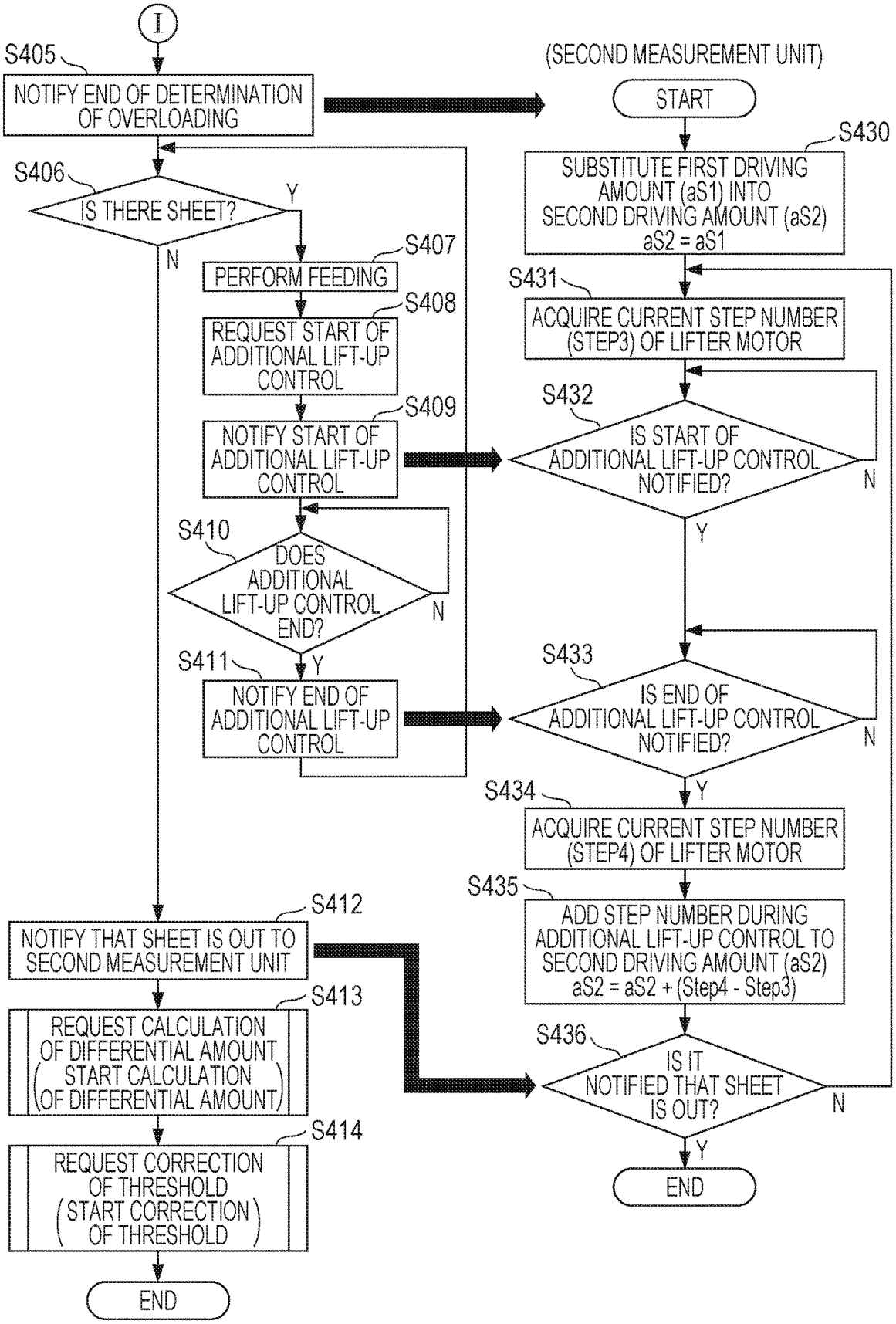

Next, cooperative processing of the lift-up control unit 230 and the overloading determination unit 210 will be described with reference to flowcharts of FIGS. 4A and 4B. Control according to the flowcharts of FIGS. 4A and 4B is executed by the CPU 201 provided in the engine control unit 200 on the basis of a program stored in the ROM 202 or the RAM 203.

When the option feeding cassette 152 is attached to the printer 101, the engine control unit 200 requests the first control unit 231 to start initial lift-up control (S400). As described above, the first control unit 231 executes the initial lift-up control in response to the request. Then, the engine control unit 200 notifies the first measurement unit 232 of start of the initial lift-up control (S401). After that, the engine control unit 200 waits for end of the initial lift-up control by the first control unit 231 (S402), and when the end of the initial lift-up control is notified from the first control unit 231, the engine control unit 200 notifies the first measurement unit 232 of the end of the initial lift-up control (S403).

When the start of the initial lift-up control is notified from the engine control unit 200, the first measurement unit 232 firstly acquires a current step number Step1 of the lifter motor 190 (S420). Next, the first measurement unit 232 waits until the end of the initial lift-up control is notified (S421). When the end of the initial lift-up control is notified from the engine control unit 200, the first measurement unit 232 acquires a current step number Step2 of the lifter motor 190 (S422). Then, the first measurement unit 232 uses Step1 and Step2 to calculate, as a first driving amount, a driving amount (aS1=Step2−Step1) of the lifter motor 190 during the initial lift-up control (S423). Note that, the driving amount aS1 of the lifter motor 190 illustrated in FIG. 4A and the driving amount a1 of the lifter motor 190 illustrated in FIG. 3 are different from each other, and a driving amount aS2 described below is also different from the driving amount a1.

When the initial lift-up control ends, the engine control unit 200 requests the determination unit 212 to determine overloading (S404). In response to the request, the determination unit 212 determines overloading. Note that, the determination processing of overloading by the determination unit 212 will be described later with reference to FIG. 5.

After the determination of overloading by the determination unit 212 ends, the engine control unit 200 notifies the second measurement unit 234 of the end of the determination of overloading (S405). Upon the notification, the second measurement unit 234 starts measurement of a second driving amount. Then, the engine control unit 200 and the second measurement unit 234 measure the second driving amount in cooperation with each other.

When a printing instruction is given from the video controller 250, the engine control unit 200 checks that there is a sheet S in the option feeding cassette 152 by the sheet presence sensor 154 (S406) and performs feeding from the option feeding cassette 152 (S407). By repeating feeding in response to the printing instruction from the video controller 250, the sheet surface of the sheet S loaded on the intermediate plate 192 of the option feeding cassette 152 is gradually lowered. Thus, when the sheet surface sensor 196 is not able to detect the sheet S, the engine control unit 200 determines that a height of the sheet surface needs to be corrected and requests the second control unit 233 to start additional lift-up control (S408). The engine control unit 200 notifies the second measurement unit 234 of start of the additional lift-up control (S409). Then, the engine control unit 200 waits for end of the additional lift-up control by the second control unit 233 (S410), and when the end of the additional lift-up control is notified from the second control unit 233, the engine control unit 200 notifies the second measurement unit 234 of the end of the additional lift-up control (S411).

The engine control unit 200 repeatedly performs the feeding control and the additional lift-up control until the sheet S on the intermediate plate 192 of the option feeding cassette 152 is out (S406). The state where the sheet S of the option feeding cassette 152 is out is able to be detected by the sheet presence sensor 154. Note that, when the sheet S of the option feeding cassette 152 is out, the engine control unit 200 notifies, to the second measurement unit 234, that the sheet S is out (S412). After that, the engine control unit 200 requests the calculation unit 214 to calculate a differential amount (S413) and requests the correction unit 211 to correct a threshold (S414). Operations of the calculation unit 214 and the correction unit 211 will be described later with reference to FIGS. 6 and 7.

The second measurement unit 234 starts processing after the end of the determination of overloading is notified from the engine control unit 200. When the end of the determination of overloading is notified from the engine control unit 200, the second measurement unit 234 receives the driving amount aS1 of the lifter motor 190 during the initial lift-up control, which is measured by the first measurement unit 232, and substitutes the driving amount aS1 to the second driving amount (aS2=aS1) (S430). Next, the second measurement unit 234 acquires a current step number Step3 of the lifter motor 190. After that, the second measurement unit 234 waits for start of the additional lift-up control being notified from the engine control unit 200 (S432). When the start of the additional lift-up control is notified, the second measurement unit 234 waits until end of the additional lift-up control is notified from the engine control unit 200 (S433). When the end of the additional lift-up control is notified from the engine control unit 200, the second measurement unit 234 acquires a current step number Step4 of the lifter motor 190. Then, the second measurement unit 234 uses Step3 and Step4 to calculate a driving amount (Step4−Step3) of the lifter motor 190 during the additional lift-up control and adds the driving amount to the second driving amount (aS2=aS2+(Step4−Step3)) (S435).

Through such processing, a sum of the driving amount of the lifter motor 190 during the initial lift-up control and the driving amount of the lifter motor 190 during the additional lift-up control (for one time) serves as a new second driving amount. Note that, until it is notified from the engine control unit 200 that the sheet S is out (S436), the second measurement unit 234 repeatedly measures the driving amount of the lifter motor 190 during the additional lift-up control, adds the driving amount to the second driving amount, and sequentially updates the second driving amount. As a result, the second measurement unit 234 measures, as the second driving amount, a cumulative driving amount of the lifter motor 190 until the sheet S of the option feeding cassette 152 is out after the option feeding cassette 152 is attached to the printer 101. In this manner, the engine control unit 200, the first measurement unit 232, and the second measurement unit 234 measure the first driving amount and the second driving amount in cooperation with each other.

Next, an operation of the determination unit 212 will be described with reference to a flowchart of FIG. 5. When determination of overloading is requested from the engine control unit 200 (S404 of FIG. 4A), the determination unit 212 firstly receives the driving amount aS1 of the lifter motor during the initial lift-up control, that is, the first driving amount from the first measurement unit 232 (S500). The determination unit 212 receives a threshold th stored in the storage unit 215 (S501). The determination unit 212 compares the first driving amount aS1 to the threshold th (S502), and determines whether or not sheets S are overloaded on the option feeding cassette 152 in accordance with a result of the comparison. When the first driving amount aS1 is smaller than the threshold th, the determination unit 212 determines that the sheets S are overloaded (S503), and otherwise, determines that the sheets S are not overloaded (S504). When the comparison is finished, the operation of the determination unit 212 ends. In this manner, the determination unit 212 determines overloading on the basis of the first driving amount and the threshold.

Note that, in a case where the determination unit 212 determines that the sheets S are overloaded, the engine control unit 200 stops a feeding operation by the pickup roller 153 even when a printing instruction is received. This makes it possible to prevent occurrence of unnecessary sheet jamming. Further, the engine control unit 200 causes the operation panel 302 to display a message indicating the overloading, so that it is possible to notify a user of occurrence of the overloading.

Figure 6:
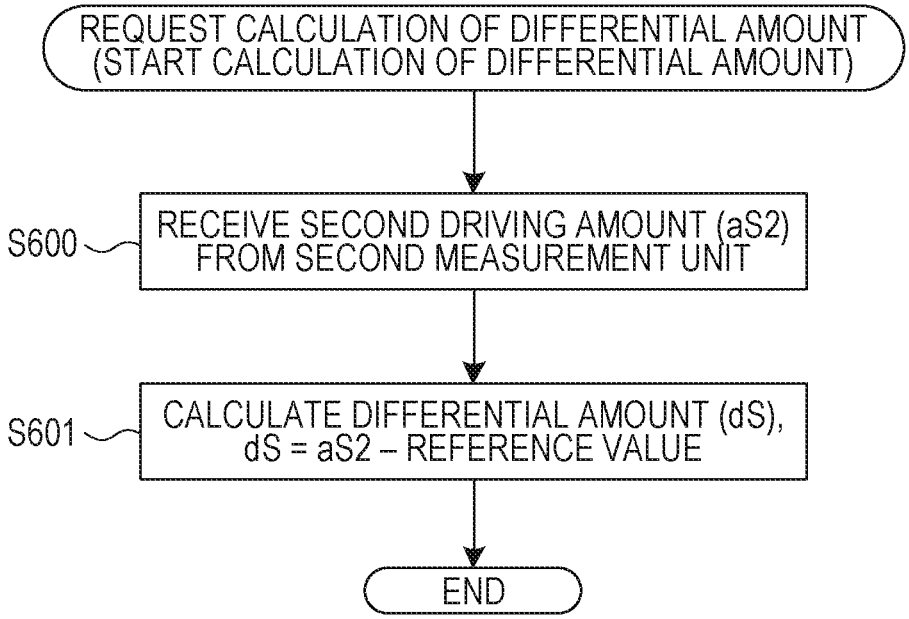
FIG. 6 is an operation flowchart of a calculation unit in Embodiment 1.

Next, the operation of the calculation unit 214 will be described with reference to a flowchart of FIG. 6. When calculation of a differential amount is requested from the engine control unit 200 (S413 of FIG. 4B), the calculation unit 214 firstly receives the second driving amount aS2 from the second measurement unit 234 (S600). By subtracting a reference value stored in advance in the storage unit 215 from the second driving amount aS2, the calculation unit 214 calculates a differential amount dS (S601). Here, the reference value is a value obtained in advance from the design drawing or the like as described above. When the calculation of the differential amount dS is finished, the operation of the calculation unit 214 ends.

Figure 7:
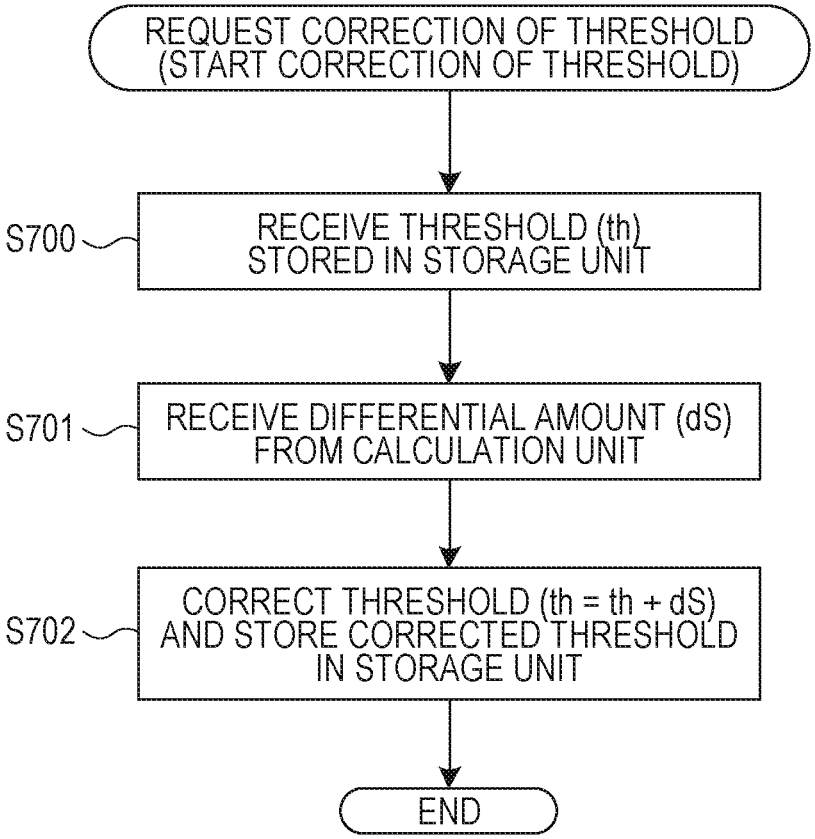
FIG. 7 is an operation flowchart of a correction unit in Embodiments 1 and 3.

Next, the operation of the correction unit 211 will be described with reference to a flowchart of FIG. 7. When correction of a threshold is requested from the engine control unit 200 (S414 of FIG. 4B), the correction unit 211 firstly acquires a threshold th for determining overloading, which is stored in the storage unit 215 (S700). The threshold th is set in accordance with a driving amount when sheets S with a maximum loading amount are loaded on the intermediate plate 192. The correction unit 211 receives the calculated differential amount dS from the calculation unit 214 (S701). By adding the differential amount dS to the threshold th, the correction unit 211 corrects the threshold th and further stores the corrected threshold th in the storage unit 215 (S702). When the new threshold th is stored, the operation of the correction unit 211 ends.

Figure 5:
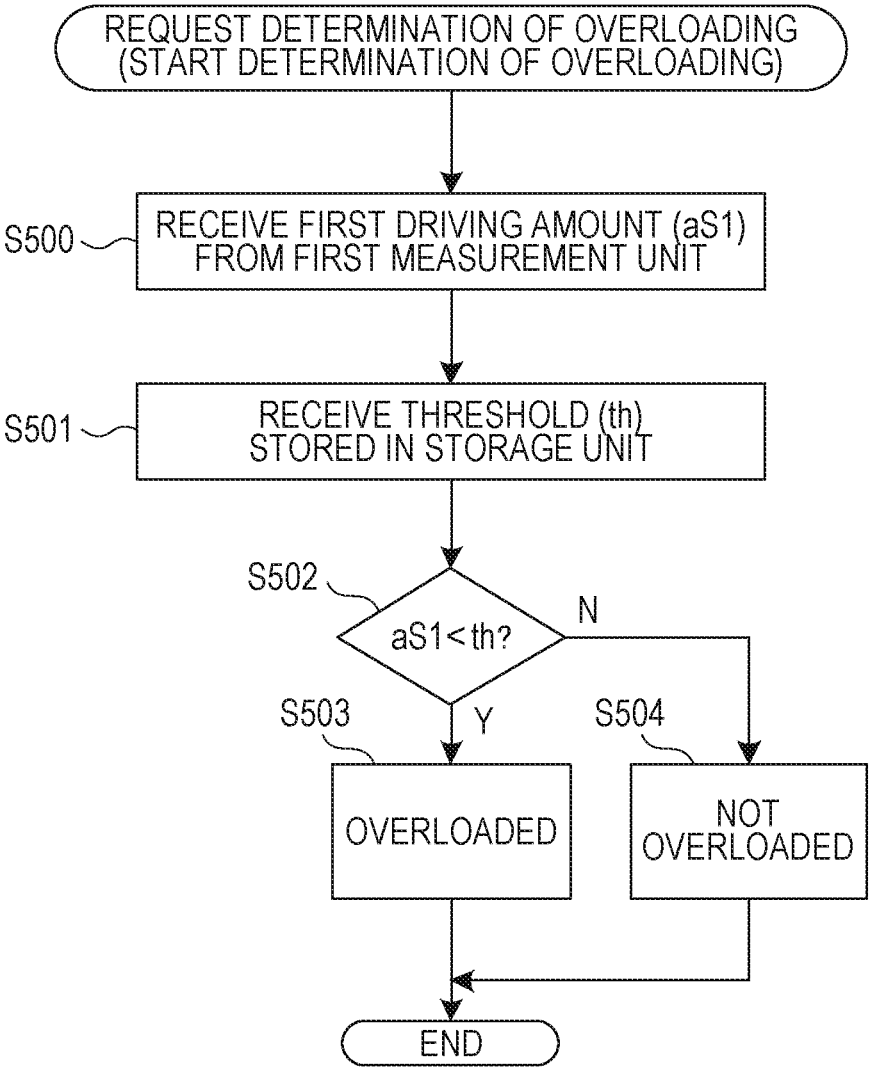
FIG. 5 is an operation flowchart of a determination unit.

The new corrected threshold th is used for determination of overloading by the determination unit 212 at the time of next initial lift-up control (S404 of FIG. 4A, and FIG. 5). In this manner, by correcting the threshold in accordance with a variation factor between apparatuses, overloading is able to be determined more accurately than a conventional manner. The update of the threshold for determining overloading may be performed every time the differential amount dS is calculated or may be performed once in several times. By updating the threshold periodically also after the printer 101 is shipped from a factory as described above, the determination of overloading is able to be performed actually even when the wire 191 is elongated with usage of the printer 101. In addition, the threshold stored in the storage unit 215 at the time of factory shipping may be a threshold that has been corrected once on the basis of the differential amount dS.

Thus, according to the present embodiment, it is possible to accurately determine whether or not a recording material is overloaded without influence of a variation factor between apparatuses.

Note that, though the control for determining overloading has been described by taking the option feed cassette 152 as an example in Embodiment 1, there is no limitation thereto. The invention may be applied to control for determining overloading of the feeding cassette 102. In this case, the intermediate plate 194 of the feeding cassette 102 is different from the intermediate plate 192 of the option feeding cassette 152 and is not configured to be lifted up or lowered by the wire 191. As the configuration of the feeding cassette 102, for example, a configuration in which an arm member (not illustrated) is operated via a gear train connected to the lifter motor 193 so that the intermediate plate 194 is pushed up from below, or the like is considered. Thus, it is considered that there is no influence of a variation factor between apparatuses that is caused, for example, when a slack of the wire 191 is eliminated, and elongation of the wire 191 due to elasticity or backlash of the wire reel 197 is eliminated. However, as an error is generated in the installation position of the sheet surface sensor 195 in the feeding cassette 102 as well, overloading is able to be determined more accurately by applying aspects of the invention.

Embodiment 2

The method for accurately determining overloading at the time of next initial lift-up control by correcting a threshold with use of a differential amount that is previously calculated has been described in Embodiment 1. However, as spring characteristics and the like of the wire 191 change in accordance with an environment (temperature, humidity) where the printer 101 is used, when a use environment is different from that in a previous lift-up operation, the driving amount of the lifter motor 190 varies and accuracy for determination of overloading may be reduced.

Then, in the present embodiment, by assuming a variation due to a difference of the use environment of the printer 101, an average value of a plurality of differential amounts that are calculated in past is obtained, a threshold is corrected on the basis of the average value, and overloading is accurately determined. As description for a main part is similar to that of Embodiment 1, only a part different from that of Embodiment 1 will be described here. Note that, it is premised in the present embodiment that the option feeding cassette 152 is configured to lift up or lower the intermediate plate 192 by the wire 191.

Operations of the engine control unit 200, the first measurement unit 232, and the second measurement unit 234 in the present embodiment are similar to those of Embodiment 1 (FIGS. 4A and 4B). An operation of the determination unit 212 is also similar to that of Embodiment 1 (FIG. 5).

Figure 8:
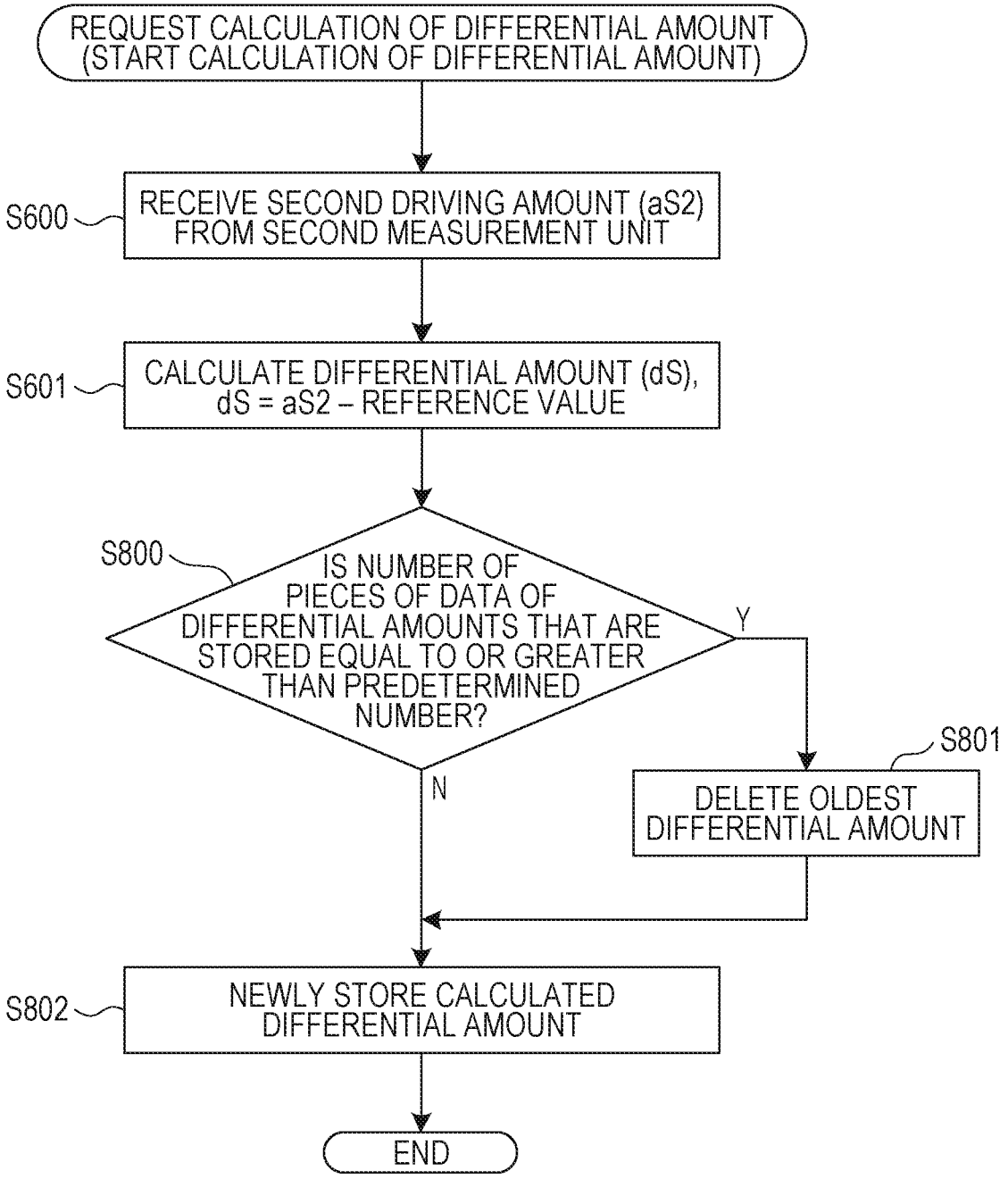
FIG. 8 is an operation flowchart of the calculation unit in Embodiment 2.

Next, an operation of the calculation unit 214 in the present embodiment will be described with reference to a flowchart of FIG. 8. When calculation of a differential amount is requested from the engine control unit 200 (S413 of FIG. 4B), the calculation unit 214 calculates the differential amount dS in a similar manner to that of Embodiment 1 (S600 and S601). Then, the calculation unit 214 checks the number of pieces of data of differential amounts stored in the storage unit 215 (S800). When the number of pieces of data of differential amounts that have been already stored reaches a predetermined number (for example, five), the calculation unit 214 deletes the oldest differential amount among the differential amounts that have been already stored (S801).

After that, the calculation unit 214 causes the storage unit 215 to store the differential amount that is calculated this time. On the other hand, when the number of pieces of data of differential amounts that have been already stored does not reach the predetermined number, the calculation unit 214 causes the storage unit 215 to directly store the differential amount that is calculated this time (S802). When a plurality of differential amounts are stored in the storage unit 215 in this manner, the correction unit 211 is able to calculate an average value of the differential amounts later. By replacing the oldest differential amount among the differential amounts that have been already stored in the storage unit 215 with a new differential amount, a differential amount according to the use environment of the printer 101 is stored. Thus, a differential amount following the use environment of the printer 101 is able to be used.

Figure 9:
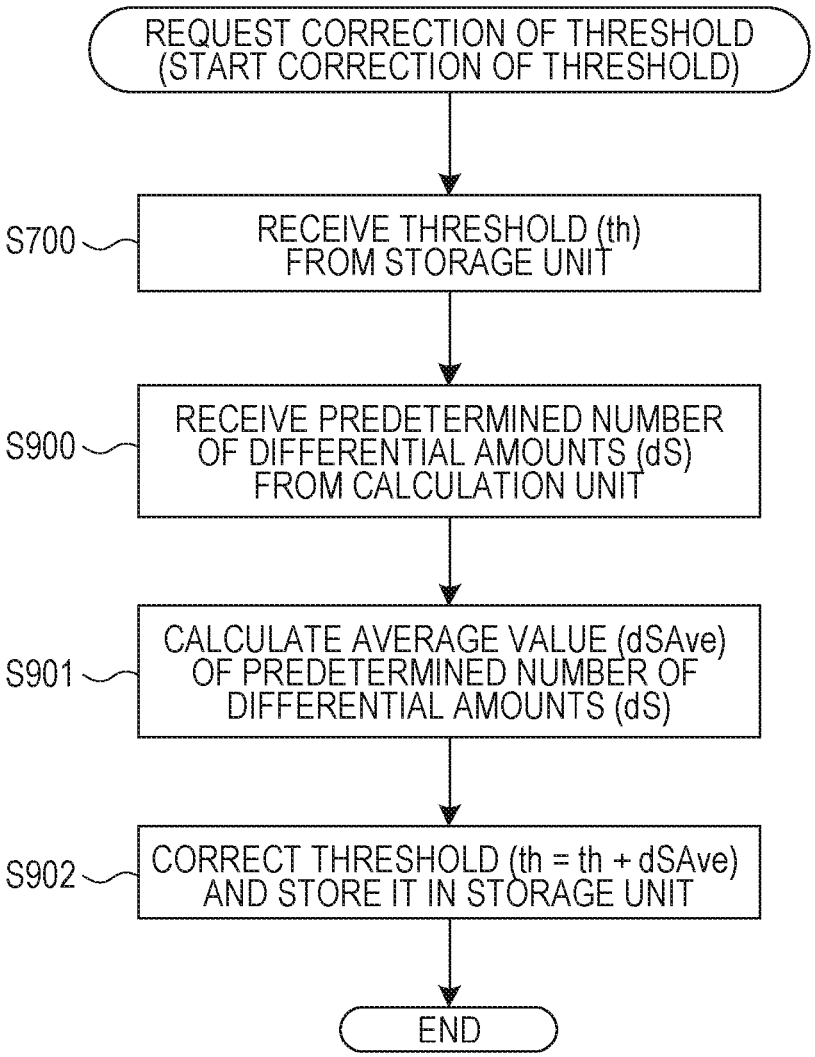
FIG. 9 is an operation flowchart of the correction unit in Embodiment 2.

Next, an operation of the correction unit 211 in the present embodiment will be described with reference to a flowchart of FIG. 9. When correction of a threshold is requested from the engine control unit 200 (S414 of FIG. 4B), similarly to Embodiment 1, the correction unit 211 acquires a threshold th that is stored in the storage unit 215 (S700). Then, the correction unit 211 receives a predetermined number of differential amounts dS stored in the storage unit 215 (S900). The correction unit 211 calculates an average value dSAve of the predetermined number of differential amounts that are received (S901). By adding the average value dSAve of the differential amounts to the threshold th, the correction unit 211 corrects the threshold th and further causes the storage unit 215 to store the corrected threshold th (S902).

Thus, according to the present embodiment, by calculating an average value of differential amounts, it is possible to reduce influence of a variation due to a use environment of an apparatus and accurately determine whether or not a recording material is overloaded.

Note that, though description has been given with use of simple average of differential amounts in Embodiment 2, there is no limitation thereto. For example, by adopting a method for calculating an average value of a plurality of differential amounts that are stored except for a maximum value and a minimum value, a variation of the differential amounts is also able to be further reduced. Though description has been given by assuming that the number of pieces of data of differential amounts stored in the storage unit 215 is five, there is no limitation thereto.

Embodiment 3

A differential amount calculated in Embodiment 1 varies in accordance with a height (loading amount) of a sheet bundle loaded on the intermediate plate 192 of the option feeding cassette 152. A relation therebetween will be described in detail with reference to FIG. 10.

Figure 10:
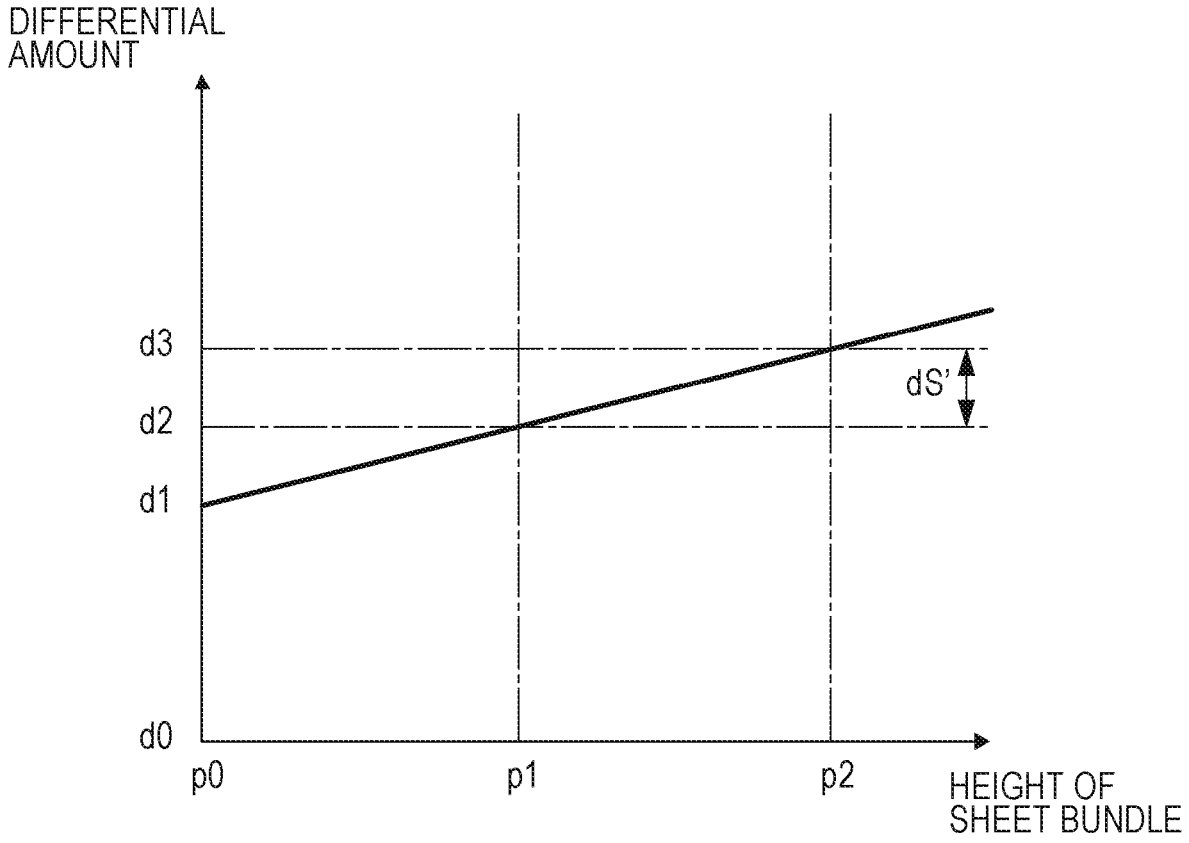
FIG. 10 is a view for explaining a relation between a height of a sheet bundle and a differential amount.

FIG. 10 is a graph illustrating a relation between the height of the sheet bundle loaded on the intermediate plate 192 and the differential amount calculated by the calculation unit 214, in which a horizontal axis indicates the height of the sheet bundle and a vertical axis indicates the differential amount. According to FIG. 10, it is found that as the height of the sheet bundle increases, the differential amount also increases. This is because as the height of the sheet bundle increases, a total weight of sheets S loaded on the intermediate plate 192 also increases, so that the wire 191 connected to the intermediate plate 192 exhibits large elongation.

In FIG. 10, a differential amount calculated when the height of sheet bundle loaded on the intermediate plate 192 is p1 is denoted by d2 and a differential amount calculated when the height of the sheet bundle is p2 higher than p1 is denoted by d3. Since p2 of p1 and p2 is closer to an overloaded state, it is desired that a threshold is corrected on the basis of the differential amount d3 in order to accurately determine overloading. However, since the loading amount of the sheets S actually loaded on the intermediate plate 192 by a user varies each time, the height of the sheet bundle is p1 in some cases. As the differential amount d2 calculated in such a case is smaller than the differential amount d3 as illustrated in FIG. 10, overloading may not be accurately determined as a result of correction of the threshold based on the differential amount d2.

Thus, in the present embodiment, the correction unit 211 calculates the height of the sheet bundle from the number and thickness of sheets S that are fed, and corrects the differential amount in accordance with the calculated height of the sheet bundle. Through the correction based on the height of the sheet bundle, the differential amount not depending on the height of the loaded sheet bundle is calculated. As description for a main part is similar to that of Embodiment 1, only a part different from that of Embodiment 1 will be described here. Note that, it is premised in the present embodiment that the option feeding cassette 152 is configured to lift up or lower the intermediate plate 192 by the wire 191.

Operations of the engine control unit 200, the first measurement unit 232, and the second measurement unit 234 in the present embodiment are similar to those of Embodiment 1 (FIGS. 4A and 4B). An operation of the determination 212 is also similar to that of Embodiment 1 (FIG. 5). An operation of the correction unit 211 is also similar to that of Embodiment 1 (FIG. 7).

Figure 11:
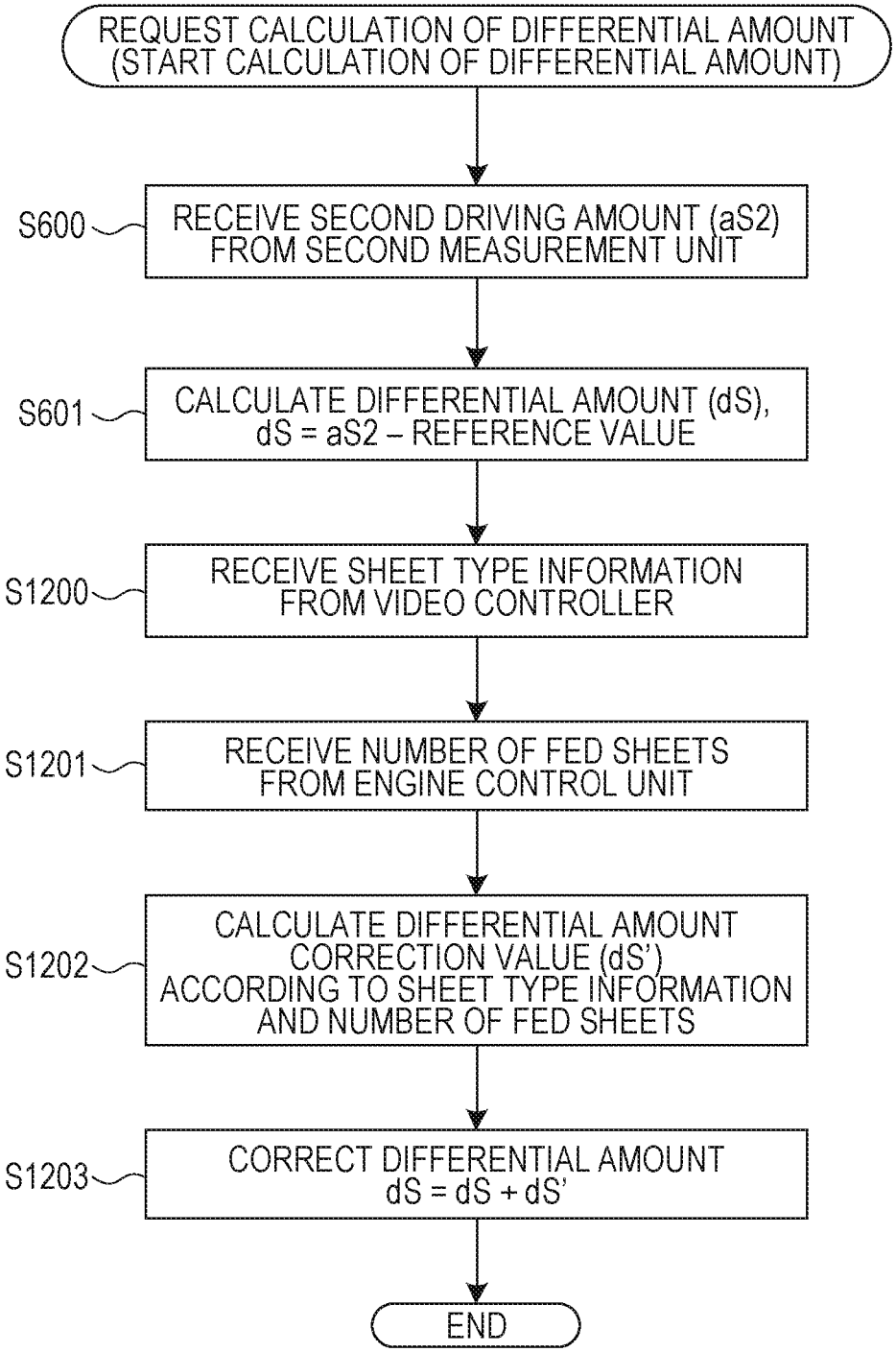
FIG. 11 is an operation flowchart of the calculation unit in Embodiment 3.

Next, an operation of the calculation unit 214 in the present embodiment will be described with reference to a flowchart of FIG. 11. When calculation of a differential amount is requested from the engine control unit 200 (S413 of FIG. 4B), the calculation unit 214 calculates the differential amount dS in a similar manner to that of Embodiment 1 (S600 and S601). Then, the calculation unit 214 causes the video controller 250 to notify sheet type information of sheets S loaded on the intermediate plate 192 (S1200). Here, the sheet type information is information of thickness of each of the sheets S. The calculation unit 214 also causes the engine control unit 200 to notify the number of fed sheets until the sheet S is out after the option feeding cassette 152 is attached to the printer 101 (S1201). The calculation unit 214 calculates the height of the loaded sheet bundle on the basis of the sheet type information and the number of fed sheets and corrects the differential amount in accordance with the height of the sheet bundle.

When the differential amount dS calculated at S601 corresponds to d2 in FIG. 10, the calculation unit 214 obtains the height p1 of the sheet bundle loaded on the intermediate plate 192. The height p1 of the loaded sheet bundle is calculated by the calculation unit 214 on the basis of the number of times of feeding counted by the engine control unit 200 and the thickness of the sheet S (Equation 1).

$$\text{height of loaded sheet bundle: } p1 = \text{number of times of feeding} \times \text{thickness of sheet } S \text{(for one sheet)} \quad \text{(Equation 1)}$$

Next, the calculation unit 214 calculates a differential amount correction value dS' in accordance with (Equation 2) (S1202). The differential amount correction value dS' corresponds to (d3−d2) in FIG. 10.

$$\text{differential amount correction value: } dS' = \alpha \times (p2 - p1) \quad \text{(Equation 2)}$$

α: correction coefficient p1: height of sheet bundle calculated by (Equation 1)

p2: height of sheet bundle corresponding to maximum loading amount

Note that, in (Equation 2), α is stored in the storage unit 215 in advance and is a value specific to an apparatus. In FIG. 10, α corresponds to a gradient of a straight line. Moreover, p2 is also stored in the storage unit 215 in advance and is obtained on the basis of the design drawing. The calculation unit 214 adds the calculated differential amount correction value dS' to the differential amount dS calculated this time (S1203). The addition corresponds to addition of the differential amount correction value (d3−d2) to the differential amount d2 in FIG. 10. That is, such control makes it possible for the calculation unit 214 to obtain the differential amount d3.

Thus, according to the present embodiment, it is possible to calculate a differential amount in a situation where determination as overloading is to be performed regardless of the loading amount of sheets S, thus making it possible to accurately determine whether or not a recording material is overloaded.

Note that, in Embodiment 3, though the calculated differential amount is corrected in accordance with a linear equation obtained in advance as illustrated in FIG. 10, a characteristic equation of a differential amount may be corrected and calculated dynamically in accordance with a use state of an apparatus.

Though the differential amount is corrected in accordance with the height of loaded sheet bundle in Embodiment 3, there is no limitation thereto. As a total weight of the sheets S changes also in accordance with a size of the sheets S or a basis weight of the sheets S, it is possible to cause the video controller 250 to notify the size of the sheets S or the basis weight of the sheets S and correct the differential amount on the basis of such sheet type information (characteristic information) of the sheets S.

Though description has been given in Embodiment 3 by taking a configuration in which sheet type information is notified from the video controller 250 as an example, there is no limitation thereto. For example, it may be configured so that an optical sensor that radiates light to a sheet S and detects a light quantity of light transmitting the sheet S may be arranged in a conveyance path of the printer 101 so that a thickness of the sheet S is automatically detected.

It may be also configured so that a plurality of differential amounts corrected in accordance with the loading amount are used by combining Embodiments 2 and 3 to determine whether or not a recording material is overloaded.

Though control for calculating a driving amount in accordance with a step number by using a stepping motor as the lifter motor 190 has been described in Embodiments 1 to 3 above, there is no limitation thereto. A type of a motor is not limited as long as the motor has a configuration which allows measurement of a driving amount of the motor. For example, a configuration in which a motor itself does not have a unit configured to detect a rotation status of the motor, but an encoder is provided in a rotation shaft of the motor to enable measurement of a driving amount of the motor may be used.

Though control for correcting a threshold on the basis of a differential amount calculated by the correction unit 211 has been described in Embodiments 1 to 3 above, there is no limitation thereto. Determination of overloading may be performed with a method for subtracting a differential amount from a first driving amount and comparing the resultant to a fixed threshold without changing the threshold.

Though a configuration in which the engine control unit 200 is provided in the printer main body 300 has been described in Embodiments 1 to 3 above, there is no limitation thereto. The engine control unit 200 may be provided in the feeding option device 301. When the engine control unit 200 is provided in the feeding option device 301, the engine control unit 200 has, instead of the image formation control unit 220 described in FIG. 2, a conveyance control unit that drives a motor for rotating a roller pair on a conveyance path to convey a sheet S. The operation panel 302 may be also provided in the feeding option device 301.

Though a laser beam printer is indicated as an example in Embodiments 1 to 3 above, the image forming apparatus to which aspects of the invention are applied is not limited thereto and a printer employing another printing system, such as an ink-jet printer, or a copier may be used.

While aspects of the present invention have been described with reference to exemplary embodiments, it is to be understood that aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2016-233346 filed Nov. 30, 2016, which is hereby incorporated by reference herein in its entirety.

What is claimed is:

1. An image forming apparatus that forms an image on a recording material, comprising:

a housing unit that includes an intermediate plate on which the recording material is loaded and is attachable to or detachable from the image forming apparatus;

a lift-up unit that lifts up the intermediate plate along a vertical direction with driving force supplied from a driving source;

a first detection unit that detects that the recording material loaded on the intermediate plate which is lifted up by the lift-up unit has reached a feeding position;

a second detection unit that detects presence of the recording material on the intermediate plate;

a feeding unit that feeds the recording material which has reached the feeding position;

a control unit that, when the housing unit is attached to the image forming apparatus, executes first lift-up control through which the intermediate plate is lifted up by the lift-up unit until the first detection unit detects that the recording material has reached the feeding position, and after the first lift-up control, executes second lift-up control through which when the first detection unit does not detect the recording material because the recording material has been fed by the feeding unit, the intermediate plate is lifted up by the lift-up unit until the first detection unit detects again that the recording material has reached the feeding position;

a first acquisition unit that acquires a first driving amount serving as a driving amount of the driving source when the first lift-up control is executed until the first detection unit detects that the recording material has reached the feeding position;

a storage unit that stores a threshold for determining overloading of the recording material on the intermediate plate;

a determination unit that determines that the recording material is overloaded on the intermediate plate when the first driving amount acquired by the first acquisition unit is smaller than the threshold;

a second acquisition unit that acquires a second driving amount obtained by adding the first driving amount to a cumulative driving amount of the driving source when the second lift-up control is executed until the second detection unit detects that there is no recording material on the intermediate plate; and a correction unit that obtains a differential amount by subtracting a predetermined driving amount from the second driving amount acquired by the second acquisition unit, and corrects, on a basis of the differential amount, the threshold stored in the storage unit or the first driving amount acquired by the first acquisition unit.

2. The image forming apparatus according to claim 1, wherein a plurality of differential amounts obtained in past are stored in the storage unit, and the correction unit corrects, on a basis of an average value of the plurality of differential amounts stored in the storage unit, the threshold stored in the storage unit or the first driving amount acquired by the first acquisition unit.

3. The image forming apparatus according to claim 1, wherein the correction unit further corrects, on a basis of information about a loading amount of the recording material loaded on the intermediate plate, the differential amount that is obtained.

4. The image forming apparatus according to claim 3, wherein on a basis of the number of recording materials fed by the feeding unit while the second lift-up control is executed until the second detection unit detects that there is no recording material after the first lift-up control is executed and characteristic information of the recording material loaded on the intermediate plate, the correction unit further corrects the differential amount that is obtained.

5. The image forming apparatus according to claim 1, wherein the correction unit corrects the threshold by adding the differential amount to the threshold stored in the storage unit or corrects the first driving amount by subtracting the differential amount from the first driving amount acquired by the first acquisition unit.

6. The image forming apparatus according to claim 1, wherein the lift-up unit includes a wire connected to the intermediate plate, and lifts up the intermediate plate when the wire is wound by the driving force supplied from the driving source.

7. The image forming apparatus according to claim 1, wherein the driving source is a stepping motor, and the first acquisition unit and the second acquisition unit count driving step numbers for driving the stepping motor to thereby acquire the first driving amount and the second driving amount, respectively.

8. The image forming apparatus according to claim 1, comprising a display unit that displays a message indicating occurrence of overloading when the determination unit determines that the recording material is overloaded on the intermediate plate.

9. The image forming apparatus according to claim 1, wherein the feeding unit stops an operation of feeding the recording material when the determination unit determines that the recording material is overloaded on the intermediate plate.

10. The image forming apparatus according to claim 1, wherein the predetermined driving amount is set in advance on a basis of a difference between a height of the intermediate plate that is lowered most in the vertical direction and a height of the second detection unit in the vertical direction.

11. A feeding apparatus that feeds a recording material, comprising:

a housing unit that includes an intermediate plate on which the recording material is loaded and is attachable to or detachable from the feeding apparatus;

a lift-up unit that lifts up the intermediate plate along a vertical direction with driving force supplied from a driving source;

a first detection unit that detects that the recording material loaded on the intermediate plate which is lifted up by the lift-up unit has reached a feeding position;

a second detection unit that detects presence of the recording material on the intermediate plate;

a feeding unit that feeds the recording material which has reached the feeding position;

a control unit that, when the housing unit is attached to the feeding apparatus, executes first lift-up control through which the intermediate plate is lifted up by the lift-up unit until the first detection unit detects that the recording material has reached the feeding position, and after the first lift-up control, executes second lift-up control through which when the first detection unit does not detect the recording material because the recording material has been fed by the feeding unit, the intermediate plate is lifted up by the lift-up unit until the first detection unit detects again that the recording material has reached the feeding position;

a first acquisition unit that acquires a first driving amount serving as a driving amount of the driving source when the first lift-up control is executed until the first detection unit detects that the recording material has reached the feeding position;

a storage unit that stores a threshold for determining overloading of the recording material on the intermediate plate;

a determination unit that determines that the recording material is overloaded on the intermediate plate when the first driving amount acquired by the first acquisition unit is smaller than the threshold;

a second acquisition unit that acquires a second driving amount obtained by adding the first driving amount to a cumulative driving amount of the driving source when the second lift-up control is executed until the second detection unit detects that there is no recording material on the intermediate plate; and a correction unit that obtains a differential amount by subtracting a predetermined driving amount from the second driving amount acquired by the second acquisition unit, and corrects, on a basis of the differential amount, the threshold stored in the storage unit or the first driving amount acquired by the first acquisition unit.

12. The feeding apparatus according to claim 11, wherein a plurality of differential amounts obtained in past are stored in the storage unit, and the correction unit corrects, on a basis of an average value of the plurality of differential amounts stored in the storage unit, the threshold stored in the storage unit or the first driving amount acquired by the first acquisition unit.

13. The feeding apparatus according to claim 11, wherein the correction unit further corrects, on a basis of information about a loading amount of the recording material loaded on the intermediate plate, the differential amount that is obtained.

14. The feeding apparatus according to claim 13, wherein on a basis of the number of recording materials fed by the feeding unit while the second lift-up control is executed until the second detection unit detects that there is no recording material after the first lift-up control is executed and characteristic information of the recording material loaded on the intermediate plate, the correction unit further corrects the differential amount that is obtained.

15. The feeding apparatus according to claim 11, wherein the correction unit corrects the threshold by adding the differential amount to the threshold stored in the storage unit or corrects the first driving amount by subtracting the differential amount from the first driving amount acquired by the first acquisition unit.

16. The feeding apparatus according to claim 11, wherein the lift-up unit includes a wire connected to the intermediate plate, and lifts up the intermediate plate when the wire is wound by the driving force supplied from the driving source.

17. The feeding apparatus according to claim 11, wherein the driving source is a stepping motor, and the first acquisition unit and the second acquisition unit count driving step numbers for driving the stepping motor to thereby acquire the first driving amount and the second driving amount, respectively.

18. The feeding apparatus according to claim 11, comprising a display unit that displays a message indicating occurrence of overloading when the determination unit determines that the recording material is overloaded on the intermediate plate.

19. The feeding apparatus according to claim 11, wherein the feeding unit stops an operation of feeding the recording material when the determination unit determines that the recording material is overloaded on the intermediate plate.

20. The feeding apparatus according to claim 11, wherein the feeding apparatus is attachable to or detachable from an image forming apparatus that forms an image on a recording material, and feeds the recording material to the image forming apparatus in a state of being attached to the image forming apparatus.

21. The feeding apparatus according to claim 11, wherein the predetermined driving amount is set in advance on a basis of a difference between a height of the intermediate plate that is lowered most in the vertical direction and a height of the second detection unit in the vertical direction.

* * * * *